United States Patent [19]

Bell et al.

[11] 3,984,232

[45] Oct. 5, 1976

[54] THERMAL UPGRADING OF SEA NODULES

[75] Inventors: Malcolm Charles Evert Bell, Sudbury; Ramamritham Sridhar, Mississauga, both of Canada

[73] Assignee: The International Nickel Company, Inc., New York, N.Y.

[22] Filed: Aug. 19, 1974

[21] Appl. No.: 498,610

[30] Foreign Application Priority Data

Aug. 22, 1973 Canada ..... 179431

[52] U.S. Cl. ..... 75/40; 75/21; 75/72; 75/80; 75/82; 75/84

[51] Int. Cl.[2] ..... C21B 11/00

[58] Field of Search ..... 75/1, 3, 21, 80, 82, 75/72, 119, 117, 121, 40, 84

[56] References Cited

UNITED STATES PATENTS

| | | | |
|---|---|---|---|
| 3,388,870 | 6/1968 | Thumm et al. | 75/21 X |
| 3,443,931 | 5/1969 | Beggs et al. | 75/21 UX |
| 3,753,686 | 8/1973 | Wilder et al. | 75/21 |
| 3,788,841 | 1/1974 | Agarwal et al. | 75/21 |

OTHER PUBLICATIONS

*Copper Metallurgy* pp. 70–82 11/71 Beck et al.

*Primary Examiner*—M. J. Andrews

*Attorney, Agent, or Firm*—Miriam W. Leff; Ewan C. MacQueen

[57] ABSTRACT

Manganiferous oxide minerals, particularly sea nodules, containing at least one metal value selected from the group consisting of cobalt, copper, iron, molybdenum and nickel and a reductant are heated to a temperature above about 1100°C. to selectively reduce the metal values to metal and only minor amounts of the manganese values to metal and to coalesce the reduced metal values. The coalesced metal values are recovered by techniques such as magnetic separation, flotation and tabling to produce a concentrate of the metal values.

25 Claims, 1 Drawing Figure

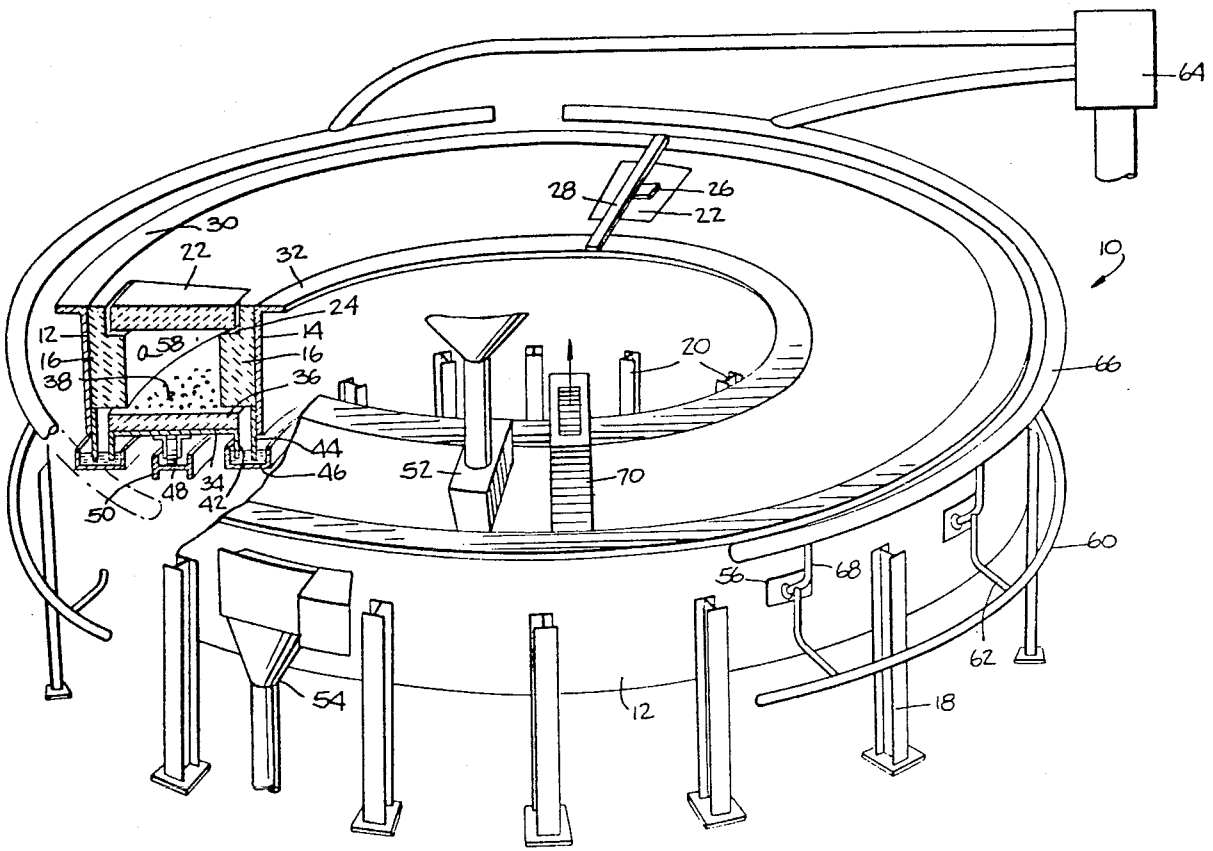
64
10
66
60
62
18
68
58
12
54
52
70
20
26
22
28
24
14
16
36
44
46
32
30
22
58
34
42
48
50
12
16
38

THERMAL UPGRADING OF SEA NODULES

The present invention relates to the recovery of non-ferrous metal values from manganiferous oxide ores and more particularly to the concentration of the non-ferrous metal values contained in manganiferous oxide ores by thermal upgrading techniques.

Although the process in accordance with the present invention is applicable to all manganiferous oxide ores that contain iron and non-ferrous metal values, the process will be described in conjunction with deep sea nodules which contain substantial amounts of manganese and iron.

Besides containing manganese and iron, deep sea nodules contain material amounts of other non-ferrous metal values, such as copper, nickel, cobalt, and molybdenum. The non-ferrous metal values can be present in a total amount of up to about 10%. Because the non-ferrous values do not occur as separate and distinct minerals, the deep sea nodules cannot without preliminary preparation be treated by conventional beneficiation techniques, such as flotation or magnetic separation, to produce non-ferrous metal concentrates. The production of non-ferrous metal value concentrates can be essential in the overall economics of recovering and refining the non-ferrous metal values contained in the sea nodules. The concentration of non-ferrous metal values improves the overall economics of non-ferrous metal value recovery by lowering the amount of material that must be treated for recovery and refining which lowers both capital and operating costs.

It has now been discovered that non-ferrous metal values contained in manganiferous deep sea nodules can be concentrated by a thermal upgrading process.

Generally speaking, the present invention contemplates a process for thermally upgrading a manganiferous oxide ore containing iron and at least one non-ferrous metal value selected from the group consisting of nickel, cobalt, copper and molybdenum. Aggregates of manganiferous oxide minerals containing at least one metal value selected from the group consisting of nickel, cobalt, copper, iron, and molybdenum, and a reductant in an amount sufficient to insure the reduction of a preponderant part of the metal value and only minor amounts of manganese are heated to a temperature above about 1100°C., e.g., above about 1200°C., to reduce a preponderant part of the metal values to metal and only minor amounts of manganese to metallic manganese and to coalesce the reduced metal values into discrete metallic particles. The reduced aggregates are cooled under conditions to minimize reoxidation of the reduced metal values, and the discrete metallic particles are recovered to provide a concentrate of the metal values.

In an advantageous embodiment of the present invention, finely-divided manganiferous oxide ore containing iron and at least one non-ferrous metal value selected from the group consisting of nickel, cobalt, copper and molybdenum and a reductant in a small but effective amount to reduce a preponderant part of the non-ferrous metal values and only controlled amounts of manganese are agglomerated. The agglomerates are heated to a temperature above about 1200°C., advantageously above the incipient fusion temperature of the agglomerates, to reduce the non-ferrous metal value to metal and coalesce the reduced non-ferrous metal values into discrete particles. The reduced agglomerates are cooled under conditions non-oxidizing to the reduced non-ferrous metal values, and discrete metal particles are recovered to provide a non-ferrous metal value concentrate.

As noted hereinbefore, the process in accordance with the present invention can be employed to thermally upgrade any manganiferous oxide ore that contains non-ferrous metal values, but the process is most advantageously employed to treat manganiferous deep sea nodules. These nodules can contain up to about 35% manganese, up to about 15% iron, up to about 2% nickel, up to about 1% cobalt, up to about 4% copper and up to about 0.5% molybdenum. Although the process in accordance with the present invention can be employed to treat manganiferous nodules having quite low non-ferrous metal value contents, it is advantageous from an economical standpoint to treat nodules containing at least about 1.5% of the non-ferrous metal value. Thus, for example, it is economically advantageous to process deep sea manganiferous nodules originating from the bed of the Pacific Ocean, which nodules contain significantly greater amounts of non-ferrous metal values as compared to those nodules originating from the bed of the Atlantic Ocean. Analyses of typical deep sea nodules that are advantageously treated by the process in accordance with the present invention are given in Table I.

TABLE I

| Ni, Wt. % | Cu, Wt. % | Co, Wt. % | Fe, Wt. % | Mn, Wt. % | $SiO_2$, Wt. % | Ca, Wt. % | Al, Wt. % | Mg, Wt. % |
|---|---|---|---|---|---|---|---|---|
| 1.2 | 0.8 | 0.2 | 5.9 | 21.8 | 22.6 | 1.9 | 3.2 | 1.9 |

It is to be noted that all solid and liquid compositions are, unless otherwise expressly stated, given on a weight basis while gaseous compositions are, except where noted, given on a volumetric basis.

As the name implies, deep sea nodules occur in the form of nodules, or more specifically in the form of aggregates of fine grained manganiferous and ferruginous minerals both of which minerals contain significant amounts of non-ferrous metal values. The nodules are naturally porous and this allows the nodules to be directly thermally upgraded without any prior treatment, particularly for the larger nodules which do not present a dusting problem. However, in most instances it has been found advantageous to comminute the sea nodules to agglomerating fineness, e.g., at least about 100% minus ¼ inch Tyler Screen Size (TSS), and to agglomerate the comminuted nodules along with a reductant and any other additive that promotes thermal upgrading. Agglomeration can be effected by any well-known means, such as pelletizing, briquetting, extrusion, and balling. The best results in terms of thermal efficiency and mechanical operation during reduction are obtained by treating agglomerates having a minimum dimension of at least about five millimeters (mm), e.g., pillow-shaped briquettes having dimensions of 25 millimeters, 40 millimeters by 40 millimeters or pellets having a minimum diameter of about 5 mm, and accordingly, the mixture of ore and reductants is advantageously formed into agglomerates having these dimensions.

Before agglomerating the comminuted nodules, a reductant in small but effective amounts to reduce a preponderant part of the non-ferrous metal value and only minor amounts of manganese can be advantageously added and blended into the comminuted nodules. In most instances, the reductant can be added to the comminuted material in amounts between about 5% and 15%, based on the weight of the nodules, and advantageously between about 8% and 12% to insure substantially complete reduction of the non-ferrous metal. Liquid hydrocarbons, particularly residual oils, and solid reductants, including coal, coke, and charcoal can be employed as reductants. Advantageously, heavy liquid hydrocarbons, such as Bunker 'B' or Bunker 'C', are employed because these oils facilitate agglomeration and provide, by vaporization and cracking, kinetically active reducing atmospheres within the agglomerates.

Concentration of the non-ferrous metal values into discrete metal particles is, in fact, a two-step process in which the oxidized non-ferrous metal values are first reduced to metal and the reduced metal values are then coalesced by diffusion to form discrete metallic particles. Various chemical reagents can be added to the agglomerates to catalyze reduction and to promote diffusion and coalescence of the reduced metal values. For example, elemental sulfur or sulfur-bearing compounds, such as iron pyrites, pyrrhotite, sodium sulfate, and calcium sulfate, can be added to the agglomerates in small but effective amounts to catalyze reduction and to promote coalescence of the reduced metal values. The beneficial effects of sulfur and sulfur-bearing compounds are maximized and reagent costs are minimized by adding sulfur or sulfur-bearing compounds to the agglomerates to provide the agglomerates with a sulfur content between about 0.2% and 2%, advantageously between about 0.5% and 1.0%. Sulfur additions above about 2% can be deleterious when the non-ferrous metal value concentrate is to be recovered by magnetic separation. However, if flotation is employed for concentrate recovery, sulfur additions up to about 10% can be used. It is believed, although the invention is not limited thereto, that a sulfide skin or shell is formed around the coalesced metal values, and if the skin or shell is too thick or too extensive the magnetic properties of the concentrate will be so altered that the efficiency of magnetic separation will be lowered. Additions of sulfur or sulfur-bearing materials to the agglomerates improves both the extent of non-ferrous metal value recovery and the grade of the concentrate obtained. For example, the addition of 1% elemental sulfur to the agglomerates can increase nickel recovery by approximately 1.4 times while improving the grade by 1.5 times, both as compared to a sample treated in a similar manner except for the absence of the sulfur additions. Non-ferrous metal value recoveries of more than about 80%, e.g., between about 80% and 96%, and concentrate grades of at least about 8%, e.g., between about 10% and 25%, are obtainable when reduction temperatures and atmospheres within the foregoing ranges are employed.

Coalescence of the reduced non-ferrous metal values can also be promoted by the use of a flux to lower the incipient fusion point of the unreduced oxides. The fluxing action increases the diffusion rate of the reduced metal values thereby aiding coalescence of the reduced metal values to discrete metal particles Examples of fluxes that can be employed are silica, calcium oxide, limestone, sodium chloride, and calcium chloride. The flux is advantageously added to the finely divided nodules in amounts up to 10%, based on the weight of the nodules. The use of fluxes within the foregoing ranges maximizes the effects attributable to the increased diffusion rate of the reduced non-ferrous metal values while minimizing reagent costs.

The agglomerates are thermally treated at a temperature of at least about 1100°C. (advantageously at least about 1150°C. and most advantageously at least about 1200°C.) to reduce a preponderant part of the non-ferrous metal values associated with the manganiferous minerals. Advantageously, the agglomerates are heated to the incipient fusion temperature of the unreduced portion of the agglomerates to promote diffusion and coalescence of the reduced non-ferrous metal values into easily recoverable discrete metallic particles. In most instances, the agglomerates will contain a reductant and control of the reducing nature of the atmosphere over the agglomerates is not critical although the atmosphere should be non-oxidizing to the reduced non-ferrous metal values. When treating manganiferous aggregates not containing a reductant, reduction temperatures between about 1100°C. and 1300°C., advantageously between about 1150°C. and 1250°C., and atmospheres having a reducing potential equivalent to a carbon dioxide to carbon monoxide ratio between about 2 to 1 and 1 to 2 are advantageously employed to reduce and coalesce the nonferrous values. Of course, atmospheres having reducing and oxidizing constituents within the foregoing ranges can be employed when reductants are incorporated in the agglomerates.

After the thermal treatment, the reduced agglomerates are cooled under conditions non-oxidizing to the reduced non-ferrous metal values. The cooled agglomerates are then crushed and ground to at least about 90% minus 100 mesh, advantageously at least about 90% minus 325 mesh, to liberate the discrete metallic particles from the bulk of the unreduced material. Conventional separation techniques, including flotation, tabling, magnetic separation, etc., are used to recover the liberated metal particles from the bulk of the material. Advantageously, magnetic separation techniques are employed to recover a concentrate containing at least about 80% of the non-ferrous metal value originally contained in the nodules and having a non-ferrous metal value content of at least about 8%.

Advantageously, the process in accordance with the present invention is conducted in a rotary hearth furnace as depicted in the accompanying FIGURE. The furnace includes concentrical circular steel walls 12 and 14 that are lined with a suitable refractory 16. Rotary hearth furnace 10 is supported by beams 18 and 20 fixedly moounted to walls 12 and 14. The top of furnace 10 can be lined with suitable refractories 22 that form a gas seal with shoulders 24 of refractory 16. Refractory 22 can be suspended by support means 26 and rod 28 which rests on flanges 30 and 32 of walls 12 and 14.

The rotary hearth is an annular shaped steel plate 34 lined with refractory 36 on which a static bed of pellets 38 is carried. Vertical flanges 42 and 44 are submerged in water trough 46 to form a gas seal. Rotary hearth 34 is also provided with steel wheel 48 that rides in thrust bearings 50 when rotary hearth 34 is rotated by means not shown in the FIGURE. Ore agglomerates are fed to rotary hearth furnace 10 via feed hopper 52, and reduced ore agglomerates are discharged by discharge mechanism 54.

TABLE III-continued

| Test No | Analysis of Non-Magnetic Tailings, Wt. % | | | | |
|---|---|---|---|---|---|
| | % Ni | % Cu | % Co | % Fe | % Mn |
| 7 | 0.06 | 0.20 | <0.02 | 3.05 | |

TABLE IV

| Test No | Metal Recoveries*, Wt. % | | | | |
|---|---|---|---|---|---|
| | % Ni | % Cu | % Co | % Fe | % Mn |
| 1 | 44.7 | | | | |
| 2 | 53.0 | | | | |
| 3 | 63.9 | 64.0 | 65.0 | 60.3 | |
| Regrind | 75.0 | 75.2 | 82.5 | | |
| 4 | 87.0 | 81.0 | 79.5 | 75.0 | 2.5 |
| 5 | 89.9 | 80.0 | 86.0 | 80.5 | 3.9 |
| 6 | 92.8 | 85.2 | 93.1 | 85.0 | 3.0 |
| 7 | 95.9 | 80.0 | 91.8 | 80.0 | |

*Based on the amount present in the original samples.

EXAMPLE II

Further tests were conducted on the same material using the same procedure set forth in Example I but with a reduction temperature of 1140°C. The material treated had an incipient fusion temperature at about 1140°C. with no flux added whereas the fusion temperature for the material was about 1250°C. Additions of 12% coal were incorporated in the briquettes and sulfur in amounts of 0, 1, 2, 4 and 6% by weight of the dry nodules were employed. The results obtained are set forth in the following Table V.

TABLE V

| % Sulfur Added | | EFFECT OF SULFUR ADDITION | | | | | |
|---|---|---|---|---|---|---|---|
| | | Wt.%[1] | %Cu | %Co | %Ni | %Fe | %Mn |
| 0 | Magnetic | 4.6 | 12.0 | 2.22 | 17.8 | 46.0 | 9.7 |
| | Non-Mag. | 95.4 | 0.83 | 0.14 | 1.10 | 4.5 | 35.2 |
| | Recovery | | 41.0 | 43.2 | 43.8 | 33.0 | 1.3 |
| 1 | Magnetic | 8.7 | 9.52 | 2.02 | 14.6 | 43.2 | 8.6 |
| | Non-Mag. | 91.3 | 0.47 | 0.07 | 0.44 | 2.8 | 35.4 |
| | Recovery | | 65.9 | 73.3 | 76.0 | 59.5 | 2.3 |
| 2 | Magnetic | 9.4 | 11.2 | 2.34 | 17.1 | 51.2 | 6.4 |
| | Non-Mag. | 90.6 | 0.31 | 0.04 | 0.18 | 1.56 | 33.2 |
| | Recovery | | 80.0 | 85.9 | 90.8 | 77.3 | 1.9 |
| 4 | Magnetic | 8.9 | 10.4 | 2.44 | 17.4 | 50.7 | 6.4 |
| | Non-Mag. | 91.1 | 0.42 | .02 | 0.17 | 1.8 | 32.6 |
| | Recovery | | 70.7 | 92.3 | 91.0 | 73.3 | 1.9 |
| 6 | Magnetic | 8.1 | 10.3 | 2.6 | 18.8 | 50.5 | 5.0 |
| | Non-Mag. | 91.9 | 0.48 | 0.02 | 0.17 | 2.0 | 31.9 |
| | Recovery | | 65.4 | 92.0 | 90.7 | 69.0 | 1.3 |

[1]Weight Percent of Heat Treated Calcine

The results of this Example II indicate that a particularly effective temperature range for reduction is about 1120°C. to about 1160°C., preferably 1130°C. to 1150°C. e.g. 1140°C.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A process for recovering a concentrate of at least one non-ferrous metal value selected from the group consisting of nickel, cobalt, copper and molybdenum from manganiferous oxide minerals which comprises heating agglomerates of manganiferous oxide minerals containing the non-ferrous metal value and a reductant to a temperature of at least about 1100°C. to reduce a preponderant part of said non-ferrous values and iron values to metal and only minor amounts of manganese values to metallic manganese and leaving an unreduced portion of said agglomerates and to coalesce the reduced metal values into discrete metallic particles within said agglomerates, cooling the thermally treated agglomerates under conditions non-oxidizing to the reduced non-ferrous metals, comminuting the resultant cooled agglomerates to liberate the discrete metal particles from the bulk of the unreduced portion, and then by a physical means separating the coalesced discrete metallic particles from the unreduced portion of the agglomerates to recover the discrete metal particles as a concentrate of the reduced metal values.

2. The process as described in claim 1 wherein the reductant is added in an amount sufficient to insure the reduction of a preponderant part of the metal value and only minor amounts of manganese.

3. The process as described in claim 1 wherein the manganiferous oxide minerals and the reductant are heated to a temperature above about 1200°C.

4. The process as described in claim 1 wherein the manganiferous oxide minerals are deep sea nodules.

5. The process as described in claim 4 wherein the deep sea nodules are comminuted, mixed with the reductant and the mixture is then agglomerated prior to being heated to temperature.

6. The process as described in claim 5 wherein the reductant is added to the comminuted deep sea nodules in an amount between about 5% and 15%, based on the weight of the deep sea nodules.

7. The process as described in claim 5 wherein the reductant is added to the comminuted deep sea nodules in an amount between about 8% and 12%, based on the weight of the deep sea nodules.

8. The process as described in claim 6 wherein the reductant is a liquid hydrocarbon.

9. The process as described in claim 6 wherein at least one additive selected from the group consisting of elemental sulfur, iron pyrites, pyrrhotite, sodium sulfate or calcium sulfate is added to the comminuted deep sea nodules in small but effective amounts to catalyze reduction and to promote coalescence of the reduced metal values.

10. The process as described in claim 9 wherein the addition is added in amounts to provide the agglomerates with a sulfur content between about 0.2% and 2%.

11. The process as described in claim 9 wherein the addition is added in amounts to provide the agglomerates with a sulfur content between about 0.5% and 1%.

12. The process as described in claim 6 wherein at least one flux selected from the group consisting of silica, calcium oxide, limestone, sodium chloride or calcium chloride is added to the comminuted sea nodules to promote coalescence of the reduced metal value.

13. The process as described in claim 12 wherein the flux is added in an amount of up to about 10%, based on the weight of the nodules.

14. The process as described in claim 6 wherein the agglomerated mixture is heated to a temperature between about 1100°C. and 1300°C.

15. The process as described in claim 6 wherein the agglomerated mixture is heated to a temperature between about 1150°C. and 1250°C.

Rotary hearth furnace 10, including refractories 16, 22 and 36, is heated by combustion of a fuel with a free-oxygen-containing gas in a plurality of burners 56 which discharge the products of combustion into the furnace via ports 58. Fuel, preferably gas, is fed to burners 56 by gas header 60 and conduit 62 while free-oxygen containing gas to support combustion is distributed to burners by blower 64 through headers 66 and conduit 68. Fuel and free-oxygen-containing gases are combusted by burners 56 to generate sufficient heat to maintain the static bed of ore agglomerates 38 at operating temperatures, and to advantageously produce atmospheres having controlled reducing potentials above the static bed. Advantageously, the ratio of fuel to free-oxygen-containing gases fed to the burners is controlled to provide an atmosphere above the bed of ore agglomerates that is at least reducing to nickel oxide in the discharge half of the furnace. Spent atmosphere is discharged via exhaust ducts 70. Advantageously, the confined space formed by refractories 36, 16 and 22 is provided with a baffle between discharge mechanism 54 and charging mechanism 52 in order to establish a flow of the products of combustion countercurrent to the movement of the rotarty hearth. The countercurrent flow of the products of combustion insures efficient utilization of the generated heat and the maintenance of proper reducing conditions within the reducing zone.

In operation, ore agglomerates are fed to feed hopper 52 and then to refractory 36 to form a shallow bed of the ore agglomerates and rotary hearth 34 is rotated in a counterclockwise direction. In a preferred embodiment, agglomerates in feed hopper 52 or in any other suitable vessel are preheated by the gases discharged by exhaust duct 70. The shallow bed of ore agglomerates 38 is heated to a temperature between about 1100°C. and 1350°C. by convection and radiation from refractory linings 16, 22 and 36. Fuel, such as natural gas, and a free-oxygen-containing gas, such as air, are combusted in a plurality of burners 56 and the products of combustion are discharged into the rotary hearth furnace via burner ports 58 to generates sufficient heat to maintain bed 38 at operating temperatures. The products of combustion are discharged from the furnace via exhaust port 70 and reduced ore agglomerates are discharged into discharge hopper 54.

For the purpose of giving those skilled in the art a better understanding of the invention the following illustrative examples are given:

EXAMPLE I

Manganiferous sea nodules having the following composition:

| Constituent | Weight % |
|---|---|
| Ni | 1.14 |
| Cu | 0.78 |
| Co | 0.19 |
| Fe | 5.9 |
| Mn | 21.5 |
| S | 0.25 |
| Mg | 3.16 |
| Ca | 1.89 |
| $SiO_2$ | 22.6 |

were ground to minus 48 mesh, TSS. Samples of the ground material were briquetted with reductants and in some of the tests with sulfur or pyrrhotite (FeS) also.

The amount of reductant and sulfur or pyrrhotite employed in each test as well as the reduction temperature used in each test are given in Table I.

The briquettes were placed in a porcelain boat and introduced into a closed end silica tube that was maintained at the test temperature. The atmosphere in the tube was maintained reducing to nickel oxide by passing therethrough a gaseous mixture containing about 7.75% hydrogen, 7.75% carbon monoxide, 15.9% carbon dioxide, 14.3% water vapor and 54.3% nitrogen.

In all tests, the porcelain boat was held at temperature for about twenty minutes before being withdrawn to the cool end of the tube. The action of a rotary hearth furnace was effectively simulated by the test procedure because the porcelain boat provided a static bed and permitted the briquettes to be rapidly heated by direct placement into the heated end of the silica tube.

After cooling, the treated briquettes were crushed and ground to 95% minus 325 mesh, TSS and the reduced nonferrous values recovered as a magnetic concentrate. In Test No. 3, the tailing from magnetic separation was reground and magnetically separated a second time. The compositions of the magnetic concentrates and of the non-magnetic tailings are given in Tables II and III, respectively. The recoveries of the non-ferrous metal values for each test are given in Table IV.

The results in Tables II, III and IV confirm (1) that sulfur or sulfur-bearing materials are highly effective in improving non-ferrous metal value recovery and in improving the grade of the concentrate, (2) that higher temperatures are more effective in improving recoveries and in improving grade of the concentrate, and (3) that coal is more effective in increasing nickel recovery

TABLE I

| Test No | Reductant Type | Reductant Wt % | Additive Type | Additive Wt % | Temp. °C. |
|---|---|---|---|---|---|
| 1 | Coke | 11.8 | — | — | 1175 |
| 2 | Coal | 11.3 | — | — | 1190 |
| 3 | Coal | 11.3 | — | — | 1215 |
| | Regrind and remagnetic separation | | | | |
| 4 | Coal | 12.0 | S | 1 | 1215 |
| 5 | Coal | 12.0 | FeS | 4 | 1220 |
| 6 | Coal | 12.0 | FeS | 4 | 1215 |
| 7 | Coal | 12.0 | FeS | 8.1 | 1215 |

TABLE II

| Test No | Wt % of Calcine | Analysis of Magnetic Concentrate, Wt. % | | | | |
|---|---|---|---|---|---|---|
| | | % Ni | % Cu | % Co | % Fe | % Mn |
| 1 | 12.7 | 4.56 | 2.86 | 0.74 | 21.1 | |
| 2 | 14.1 | 4.94 | 3.10 | 0.85 | 27.2 | |
| 3 | 11.1 | 7.96 | 5.40 | 1.34 | 41.2 | |
| 4 | 10.5 | 12.0 | 7.95 | 2.0 | 57.7 | 5.95 |
| 5 | 14.3 | 9.04 | 5.29 | 1.47 | 59.8 | 6.78 |
| 6 | | 7.74 | 4.85 | 1.34 | 60.7 | 6.4 |
| 7 | | 8.13 | 4.19 | 1.22 | 63.6 | |

TABLE III

| Test No | Analysis of Non-Magnetic Tailings, Wt. % | | | | |
|---|---|---|---|---|---|
| | % Ni | % Cu | % Co | % Fe | % Mn |
| 1 | 0.82 | 0.62 | 0.14 | 4.9 | |
| 2 | 0.72 | 0.53 | 0.11 | 4.08 | |
| 3 | 0.56 | 0.38 | 0.09 | 3.41 | |
| Regrind | 0.40 | 0.28 | 0.05 | | |
| 4 | 0.21 | 0.22 | 0.05 | 2.3 | 27.4 |
| 5 | 0.17 | 0.21 | 0.04 | 2.4 | 27.6 |
| 6 | 0.106 | 0.15 | 0.017 | 1.82 | 31.0 |

16. The process as described in claim 6 wherein the coalesced metal values are recovered by flotation, tabling, or magnetic separation.

17. The process as described in claim 1, in which the reduction is carried in a temperature range of from about 1120°C to about 1160°C.

18. the process as described in claim 1, in which the reduction is carried out in a temperature range of from about 1130°C to about 1150°C.

19. The process as described in claim 1, in which the reduction is carried out at a temperature of about 1140°C.

20. The process as described in claim 4, in which the reduction is carried out in a temperature range of from about 1120°C to about 1160°C.

21. The process as described in claim 1 in which the reduction is carried out by feeding the agglomerates as a static bed through a rotary hearth furnace.

22. A process for recovering a concentrate of at least one non-ferrous value selected from the group consisting of nickel, cobalt, copper and molybdenum from manganiferous oxide minerals which comprises heating agglomerates of manganiferous oxide minerals containing the non-ferrous metal value and a reductant at a temperature of at least about 1100°C. to reduce a preponderant part of said non-ferrous values and iron values to metal and only minor amounts of manganese values to metallic manganese and leaving an unreduced portion of said agglomerates and to coalesce the reduced metal values into discrete metallic particles, said temperature for reducing the agglomerates and coalescing the reduced metal values being substantially the incipient fusion temperature of the unreduced portion of said agglomerates, cooling the thermally treated agglomerates under conditions non-oxidizing to the reduced non-ferrous metals, comminuting the resultant cooled agglomerates to liberate the discrete metal particles from the bulk of the unreduced portion, and then by a physical means separating the coalesced discrete metallic particles from the unreduced portion of the agglomerates to recover the discrete metal particles as a concentrate of the reduced metal values.

23. The process as described in claim 22 in which the reduction is carried out by feeding the agglomerates as a static bed through a rotary hearth furnace.

24. The process as described in claim 22 wherein sulfur is provided in the agglomerates in an amount of up to about 10%.

25. The process as described in claim 1 wherein said unreduced portion of the agglomerates separated from the coalesced particles contains a preponderant part of the manganese values.

* * * * *